US006209348B1

(12) United States Patent
Shinmura et al.

(10) Patent No.: US 6,209,348 B1
(45) Date of Patent: Apr. 3, 2001

(54) CONDENSER EQUIPPED WITH RECEIVER

(75) Inventors: Toshiharu Shinmura, Sawa-gun; Hirotaka Kado, Isesaki, both of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/340,664

(22) Filed: Jun. 29, 1999

(30) Foreign Application Priority Data

Jul. 23, 1998 (JP) ..... 10-208029

(51) Int. Cl.[7] ..... F25B 39/04; F25B 1/00
(52) U.S. Cl. ..... 62/509; 165/110
(58) Field of Search ..... 62/509; 165/173, 165/110

(56) References Cited

U.S. PATENT DOCUMENTS 4,577,469 * 3/1986 Okura ..... 62/509 X
4,649,719 * 3/1987 Yanagisawa ..... 62/509 X
5,713,217 * 2/1998 Baba ..... 62/509
5,868,002 * 2/1999 Matsubayashi ..... 62/509 X
6,000,465 * 12/1999 Kawahara ..... 62/509 X

FOREIGN PATENT DOCUMENTS

404043271 * 2/1992 (JP) .
406094330 * 4/1994 (JP) .
8-035744 2/1996 (JP) .
8-075317 3/1996 (JP) .
8-110125 4/1996 (JP) .
9-184668 7/1997 (JP) .
9-217967 8/1997 (JP) .

* cited by examiner

*Primary Examiner*—Corrine McDermott
*Assistant Examiner*—Chen-Wen Jiang
(74) *Attorney, Agent, or Firm*—Baker Botts L.L.P.

(57) ABSTRACT

A condenser equipped with a receiver includes an inlet portion for refrigerant of the receiver opening in an axial direction of the receiver; an outlet portion for refrigerant of the condenser communicating with the inlet portion of the receiver; and an insertion portion provided on either the inlet portion or the outlet portion. The insertion portion is inserted into the outlet portion or the inlet portion, and the inlet portion and the outlet portion are brought into contact with each other to make a gastight condition between the inlet portion and the outlet portion. In this structure, the workability for attaching the receiver to the condenser and detaching the receiver from the condenser may be improved. Moreover, the strength for fixing the receiver to the condenser may be increased.

9 Claims, 5 Drawing Sheets

CONDENSER EQUIPPED WITH RECEIVER

BACKGROUND OF THE INVENTION

1. Field of the Invention

The present invention relates to a condenser equipped with a receiver, and more specifically to a condenser equipped with a receiver, suitable for use in a refrigerating cycle of an air conditioner for vehicles.

2. Description of the Prior Art

Generally, in a vehicle air conditioner, the refrigeration cycle components, for example, a compressor, a condenser, a receiver, etc., are mounted on a vehicle as individual parts. However, due to recent space saving requirements accompanying the development of a compact engine compartment, a condenser integrally structured with a receiver has been proposed (for example, JP-A-8-35744, JP-A-8-110125), or, a condenser equipped with a receiver after manufacturing the condenser and the receiver separately from each other has been proposed. JP-A-8-75317, JP-A-9-184668 and JP-A-9-217967, all of which are incorporated by reference, in their entireties, show typical condensers equipped with receivers.

In such known condensers equipped with receivers, however, several problems exist in a communication portion between an outlet portion of a condenser and an inlet portion of a receiver. For example, in JP-A-8-75317, because a refrigerant pipe that is connected to an outlet portion of a condenser is drawn around, and a nut that is provided on an end of the refrigerant pipe is screwed to a connector provided on an inlet portion of a receiver, screwing operation is required, thus decreasing the workability for the assembly of the receiver to the condenser. In JP-A-9-184668, a connection block that is provided on a condenser and an attachment block that is provided on a receiver are connected by bolts with a liquid-tight condition. However, because an outlet portion of a condenser is usually provided at a lower position of the condenser, such as in the structure disclosed in JP-A-9-184668, detachment of the receiver from the condenser after the assembly on a vehicle may be difficult, thereby decreasing the maintainability. Moreover, because the receiver is fixed to the condenser only by the bolts for connecting the connection block and the attachment block, the connection strength may be poor. In JP-A-9-217967, the strength of the connection is improved, but the workability for the assembly of the receiver to the condenser is correspondingly decreased.

SUMMARY OF THE INVENTION

Accordingly, it is an object of the present invention to provide an improved structure for a condenser equipped with a receiver which may increase the workability for the assembly of the receiver to the condenser, as well as the strength of the connection between the receiver and the condenser. In addition, it is an object of the invention to increase the maintainability of the receiver after installation in a vehicle.

To achieve the foregoing and other objects, the structure of a condenser equipped with a receiver according to the present invention is herein provided. The condenser equipped with a receiver comprises an inlet portion for refrigerant of the receiver opening in an axial direction of the receiver, an outlet portion for refrigerant of the condenser communicating with the inlet portion for refrigerant of the receiver, and an insertion portion provided on either the inlet portion or the outlet portion. The insertion portion is inserted into the outlet portion or the inlet portion, and the inlet portion and the outlet portion are brought into contact with each other to make a gastight condition between the inlet portion and the outlet portion.

The condenser may comprise a multi-flow type heat exchanger including a pair of header pipes, a plurality of heat transfer tubes interconnecting the pair of header pipes, and a plurality of fins disposed between heat transfer tubes adjacent to each other. The receiver may be provided so as to extend in a direction parallel to a direction in which the heat transfer tubes extend. In this embodiment, the receiver may be fixed to a side member provided at one of outermost positions of the multi-flow type heat exchanger. Alternatively, the receiver may be provided so as to extend in a direction parallel to a direction in which one of the pair of header pipes extends. In this embodiment, the receiver may be fixed to one of the pair of header pipes directly or via a bracket.

The receiver may contain a desiccant and at least one filter. The receiver may have an auxiliary equipment such as a pressure switch or a fusible plug.

In the condenser equipped with a receiver according to the present invention, the receiver may be easily attached to the condenser while a gastight condition between the outlet portion of the condenser and the inlet portion of the receiver may be ensured, merely by moving the receiver in its axial direction, inserting the insertion portion into the outlet portion or the inlet portion and bringing the inlet portion into contact with the outlet portion. Further, the receiver may be easily detached from the condenser by moving the receiver in a direction opposite to the above-described inserting direction. Therefore, the workability for attaching the receiver to the condenser, and the maintainability after mounting the assembly on a vehicle (the detachment ability of the receiver), may be increased.

Moreover, because the receiver may be disposed in either a direction parallel to the heat transfer tubes or a direction parallel to the header pipe of the condenser, an optimum assembly direction may be selected in consideration of a space in an engine compartment of a vehicle and maintenance efficiency.

Furthermore, because the receiver may be fixed to the condenser on the side member or the header pipe of the condenser by an appropriate fixing method, the strength for fixing the receiver to the condenser may be increased while the maintainability is increased.

Further objects, features, and advantages of the present invention will be understood from the following detailed description of the preferred embodiments of the present invention with reference to the accompanying figures.

BRIEF DESCRIPTION OF THE DRAWINGS

Embodiments of the invention are now described with reference to the accompanying figures, which are given by way of example only, and are not intended to limit the present invention.

DETAILED DESCRIPTION OF PREFERRED EMBODIMENTS

Figure 1:
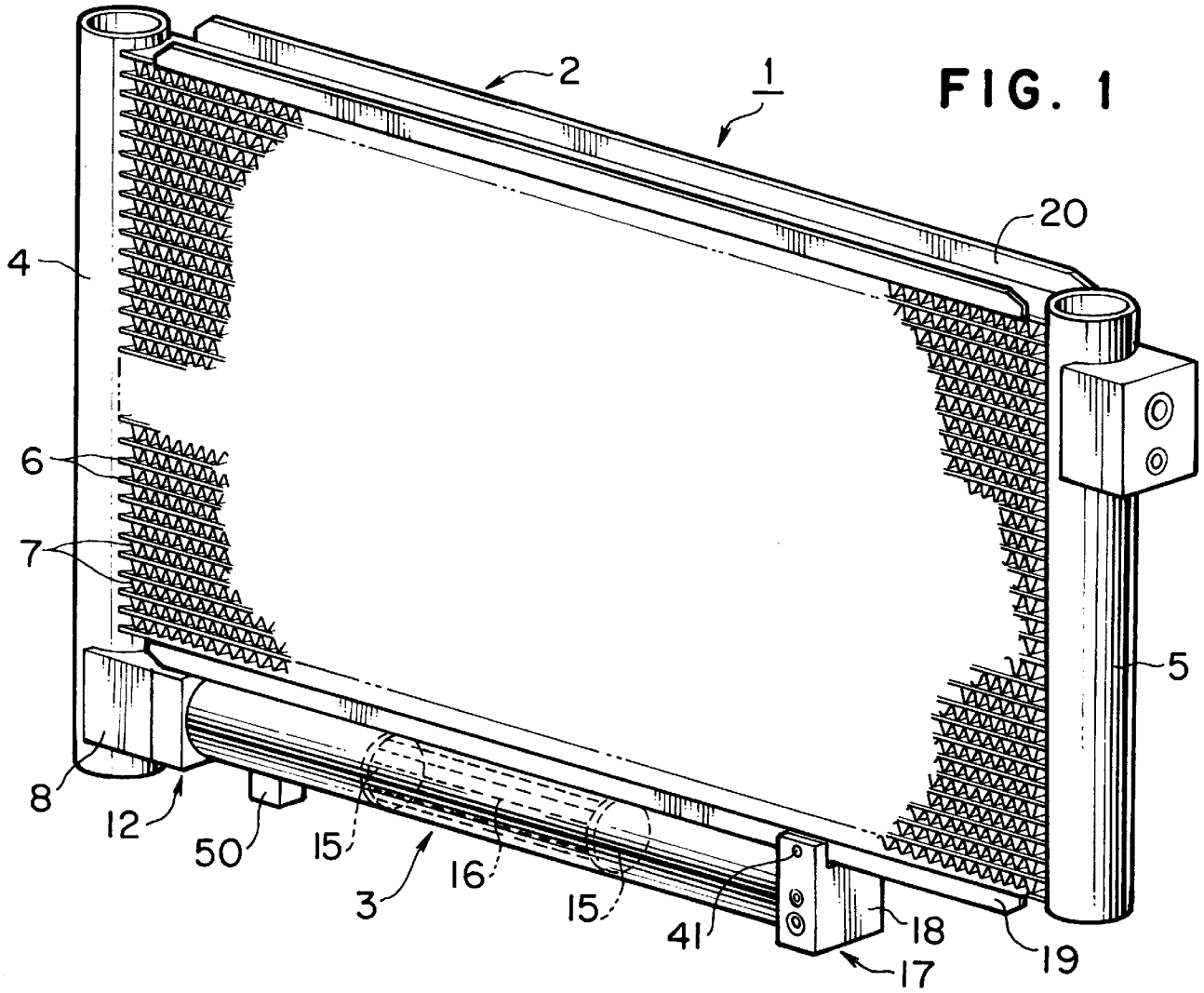
FIG. 1 is a perspective view of a condenser equipped with a receiver according to a first embodiment of the present invention.
Figure 2:
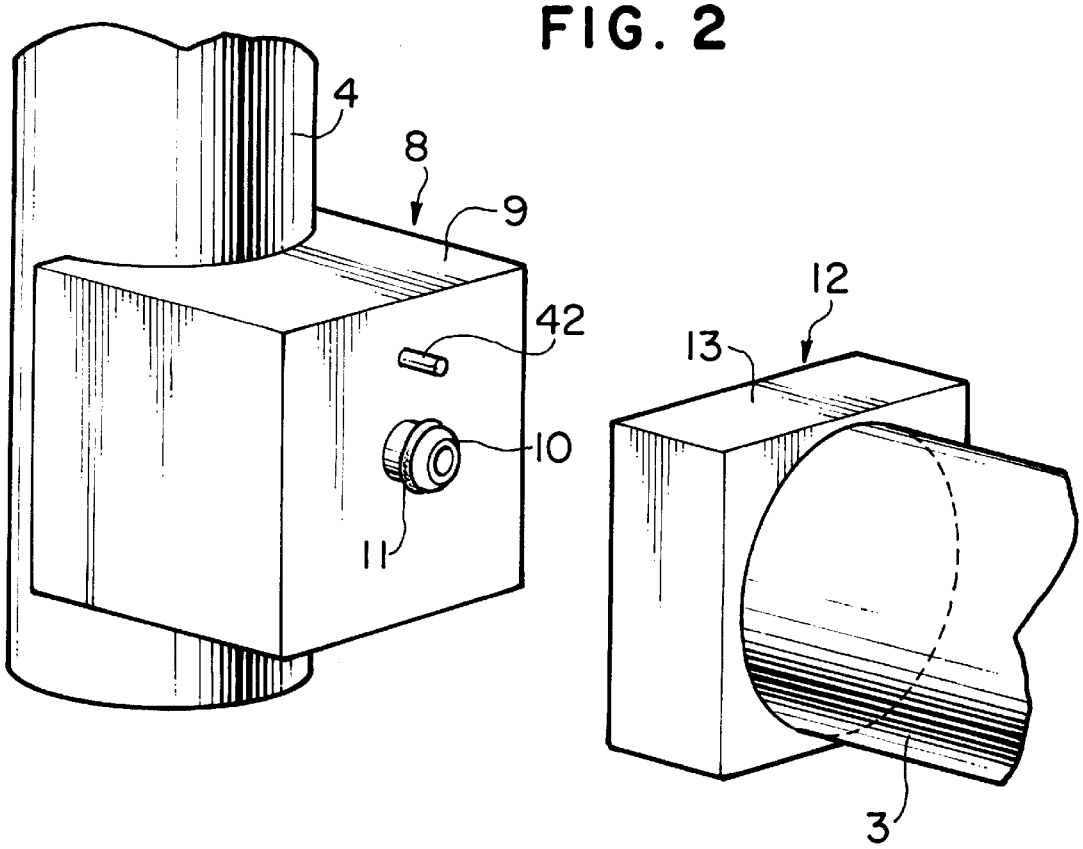
FIG. 2 is an enlarged, exploded, partial perspective view of the condenser equipped with a receiver depicted in FIG. 1.
Figure 3:
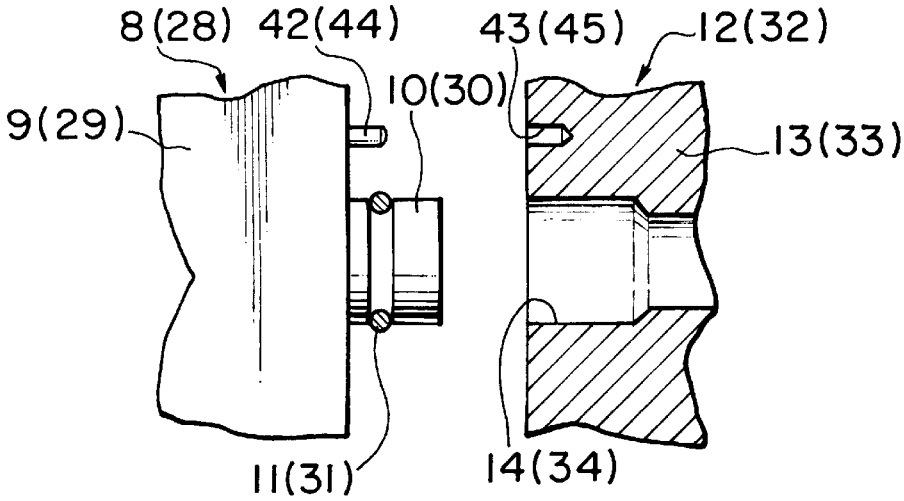
FIG. 3 is a vertical sectional view of the connection portion depicted in FIG. 2.

Referring to FIGS. 1 to 3, a condenser equipped with a receiver according to a first embodiment of the present invention is provided. In FIG. 1, condenser equipped with a receiver 1 comprises condenser 2 and receiver 3 assembled thereto. In this embodiment, condenser 2 is formed as a multi-flow type heat exchanger including a pair of header pipes 4, 5 disposed in parallel to each other. A plurality of heat transfer tubes 6 disposed in parallel to each other with a predetermined interval (for example, flat-type refrigerant tubes) fluidly interconnect the pair of header pipes 4, 5. Corrugated fins 7 are interposed between the respective adjacent heat transfer tubes 6 and outside of the outermost heat transfer tubes 6 as outermost fins. Side members 19, 20 are provided on outermost fins 7, respectively.

An outlet portion 8 for introducing refrigerant out from condenser 2 is provided on the lower portion of header pipe 4. Outlet portion 8 comprises a block 9 and an insertion portion 10 projected from block 9, as depicted in FIGS. 2 and 3. O-ring 11 is attached on the periphery of insertion portion 10. Pin 42 is provided on the same surface as provided with insertion portion 10 of block 9 for positioning.

Receiver 3 has an inlet portion 12 for introducing refrigerant into receiver 3 at one end of receiver 3. Inlet portion 12 is formed as a block 13. Block 13 has an insertion hole 14 opening in the axial direction of receiver 3 and a positioning hole 43. Insertion portion 10 is inserted into insertion hole 14. Pin 42 is inserted into positioning hole 43 for fixing the relative positional relationship between condenser 2 and receiver 3. The surface of block 9 and the surface of block 13 facing each other are brought into contact with each other.

Receiver 3 contains filters 15 and desiccant 16. Filters 15 fix desiccant 16 from both sides in receiver 3. Receiver 3 also may have auxiliary equipment. In this embodiment, a pressure switch 50 is attached on receiver 3 for detecting a pressure of refrigerant in receiver 3.

In this embodiment, receiver 3 is disposed at the bottom portion of condenser 2 so that receiver 3 extends in a direction parallel to the direction in which heat transfer tubes 6 extend. Outlet portion 8 of condenser 2 communicates with inlet portion 12 of receiver 3 with a gastight condition by inserting insertion portion 10 provided on block 9 into insertion hole 14 defined in block 13. At the same time, block 9 and block 13 are positioned in a predetermined positional relationship by inserting pin 42 into positioning hole 43. Receiver 3 is disposed on lower side member 19 provided on one of the outermost fins 7 of condenser 2. A block 18 forming an outlet portion 17 of refrigerant of receiver 3 provided on the other end of receiver 3 is fixed to side member 19 via screw 41.

In condenser equipped with a receiver 1 of this embodiment, receiver 3 is attached to condenser 2 as follows. Insertion portion 10 of outlet portion 8 of condenser 2 is inserted into inlet portion 12 of receiver 3 by moving receiver 3 in its axial direction. O-ring 11 serves to achieve a gastight connection between insertion portion 10 and inlet portion 12. At the same time, pin 42 is inserted into positioning hole 43 so that receiver 3 is positioned relative to condenser 2 accurately at a predetermined positional relationship. Block 9, forming outlet portion 8, and block 13, forming inlet portion 12, are brought into contact with each other. Thus, outlet portion 8 of condenser 2 and inlet portion 12 of receiver 3 are assembled to each other and communicate with each other at a gastight condition by such an operation. When receiver 3 is detached from condenser 2, receiver 3 may be merely moved in its axial direction opposite to the direction for attachment. Thus, the detachment or separation of receiver 3 from condenser 2 may be achieved by such an operation. As a result, the workability for the assembly of receiver 3 to condenser 2 and the maintainability of receiver 3 after it is mounted on a vehicle may both be improved.

Further, in this embodiment, one end portion of receiver 3, that is, inlet portion 12 of receiver 3, is fixed to outlet portion 8 of condenser 2 via the insertion structure of insertion portion 10, and the other end portion of receiver 3, that is, outlet portion 17 of receiver 3, is fixed to side member 19 which is sufficiently strong. Therefore, receiver 3 may be fixed to condenser 2 at both end portions with a sufficiently strong connection, thereby ensuring a sufficiently strong connection between receiver 3 and condenser 2. Further, in this embodiment, because outlet portion 17 of receiver 3 is fixed to side member 19 via screw 41, the attachment of receiver 3 to condenser 2 and the detachment of receiver 3 from condenser 2 may both be facilitated. Although outlet portion 17 of receiver 3 is fixed directly to side member 19 in this embodiment, outlet portion 17 also may be fixed via a bracket (not shown) connected to side member 19.

Figure 4:
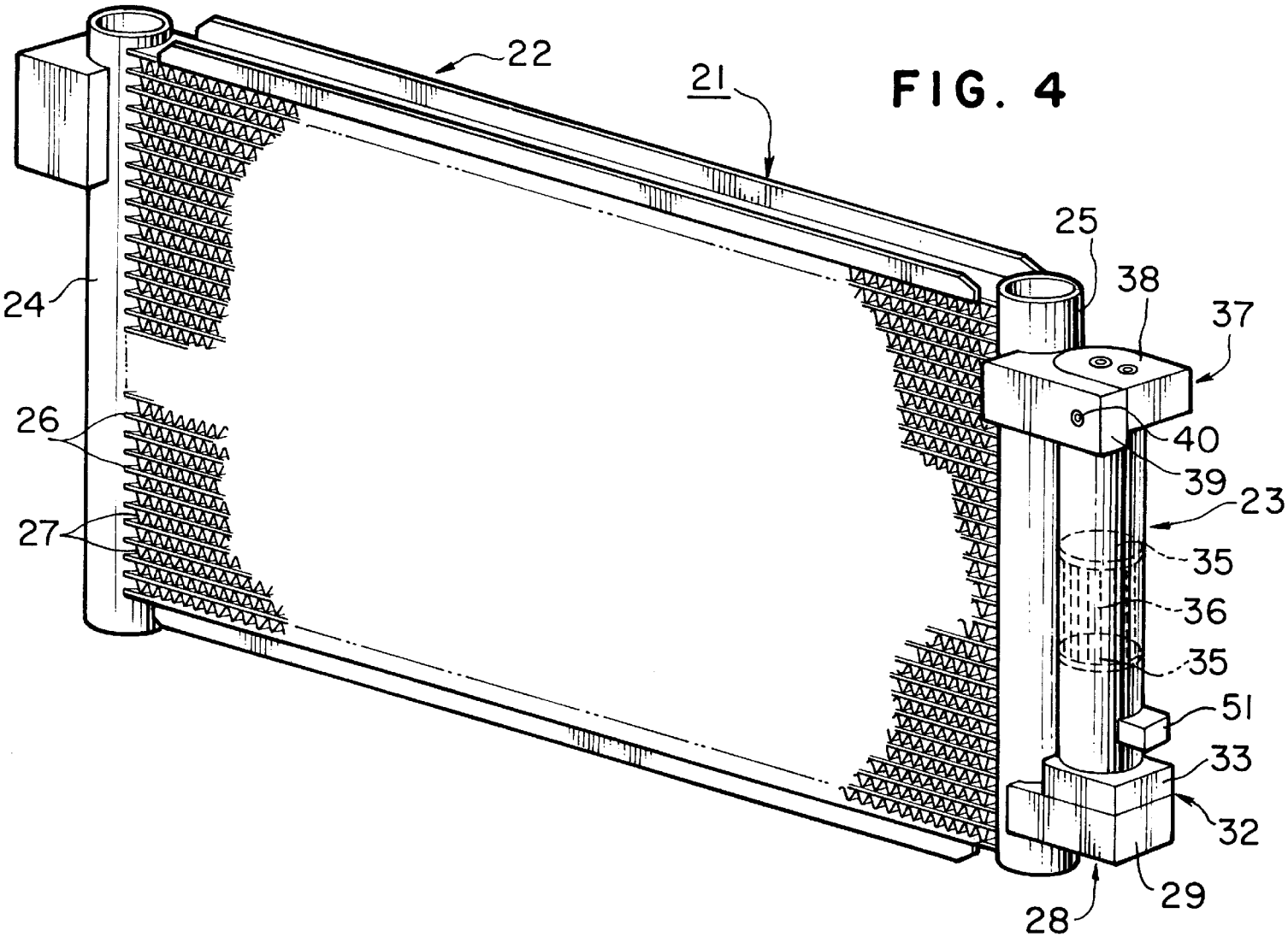
FIG. 4 is a perspective view of a condenser equipped with a receiver according to a second embodiment of the present invention.
Figure 5:
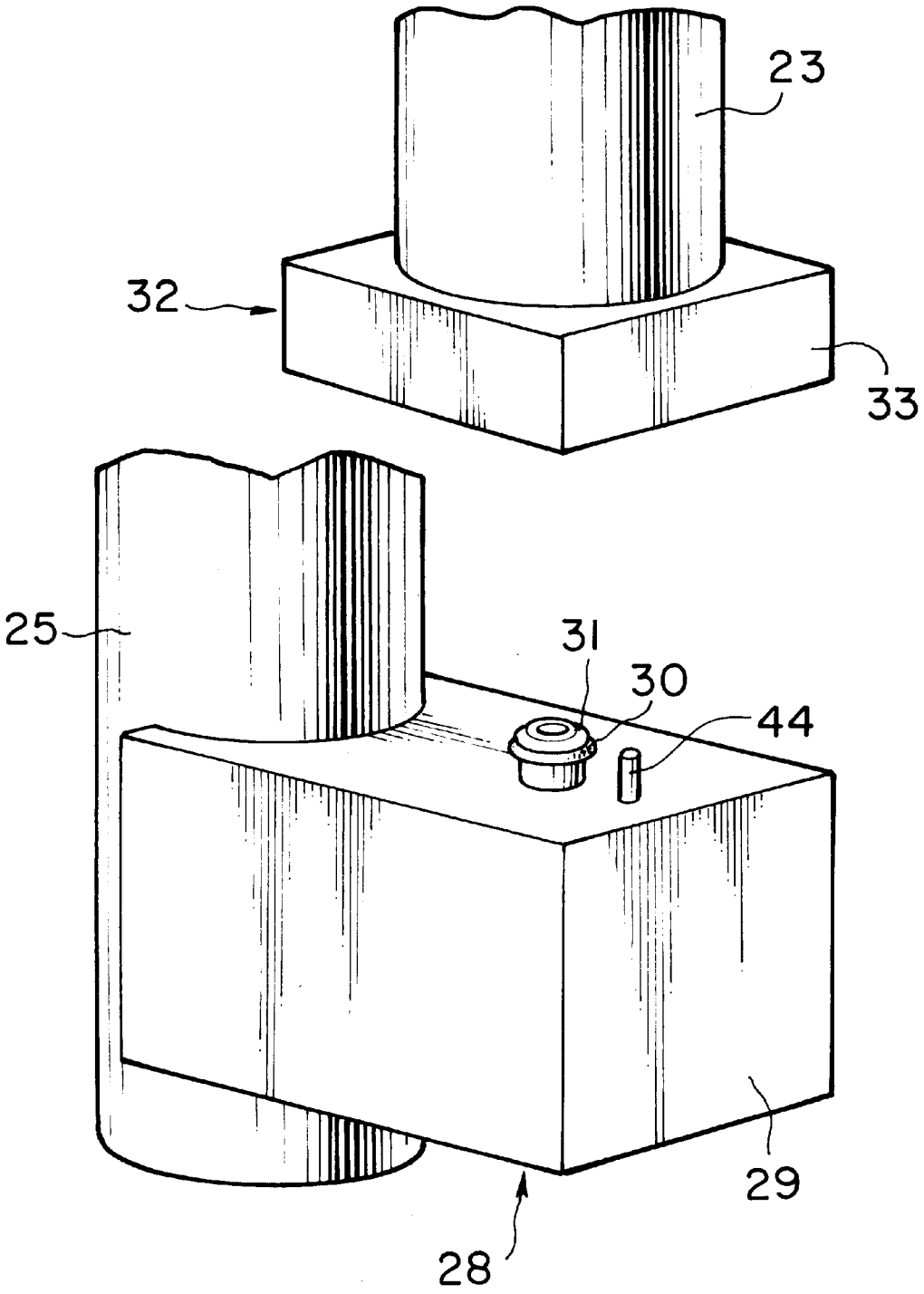
FIG. 5 is an enlarged, exploded, partial perspective view of the condenser equipped with a receiver depicted in FIG. 4, showing the connection portion.
Figure 6:
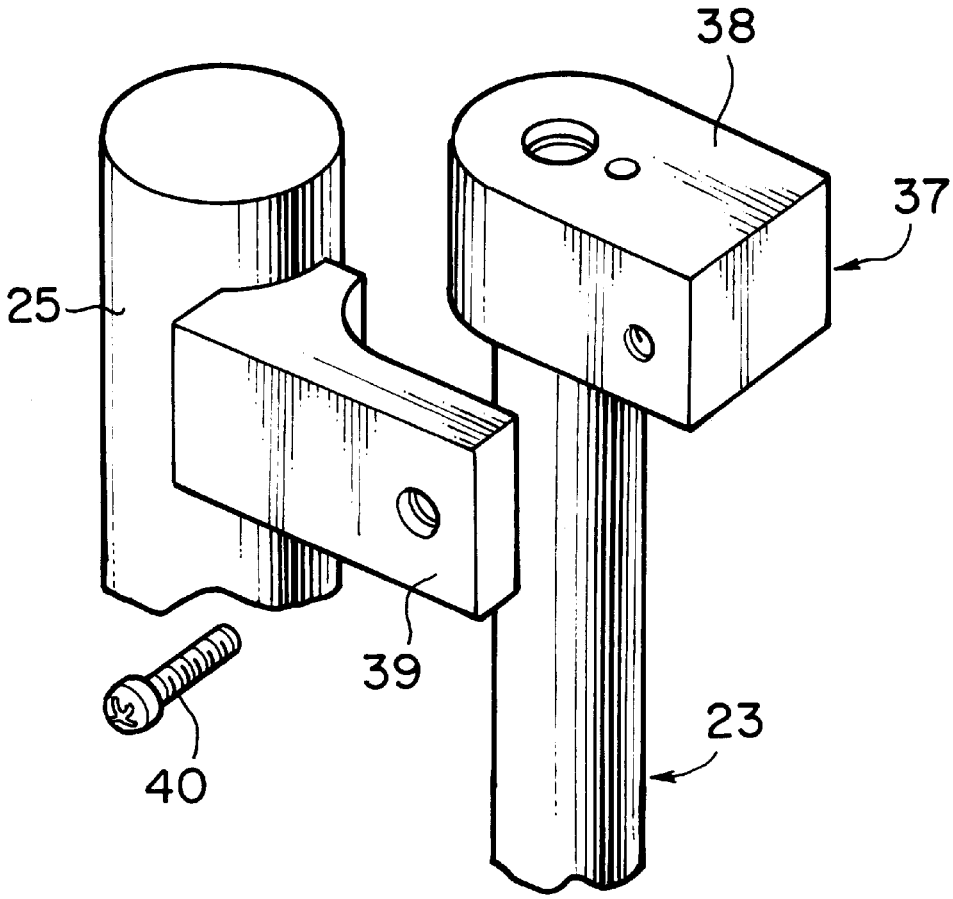
FIG. 6 is an enlarged, exploded, partial perspective view of the condenser equipped with a receiver depicted in FIG. 4, showing the fixing portion.

FIGS. 4 to 6 depict a condenser equipped with a receiver according to a second embodiment of the present invention. In FIG. 4, condenser equipped with a receiver 21 comprises condenser 22 and receiver 23 assembled thereto. In this embodiment, condenser 22 is formed as a multi-flow type heat exchanger including a pair of header pipes 24, 25 disposed in parallel to each other. A plurality of heat transfer tubes 26 disposed in parallel to each other at a predetermined interval (for example, flat-type refrigerant tubes) fluidly interconnect the pair of header pipes 24, 25. Corrugated fins 27 are interposed between the respective adjacent heat transfer tubes 26 and outside of the outermost heat transfer tubes 26 as outermost fins.

An outlet portion 28 for introducing refrigerant out from condenser 22 is provided on the lower portion of header pipe 25. Outlet portion 28 comprises a block 29 and an insertion portion 30 projecting from block 29, as depicted in FIG. 5. O-ring 31 is attached on the periphery of insertion portion 30. Pin 44 is provided on the same surface that is provided with insertion portion 30 of block 29 for positioning.

Receiver 23 has an inlet portion 32 for introducing refrigerant into receiver 23 at an lower end of receiver 23. Inlet portion 32 is formed as a block 33. The connection structure of outlet portion 28 and inlet portion 32 is substantially the same as that in the first embodiment. Therefore, the labels of the elements in this portion of the second embodiment are shown in FIG. 3 in parenthesis. Namely, block 33 has an insertion hole 34 opening in the axial direction of receiver 23 and a positioning hole 45. Insertion portion 30 is inserted into insertion hole 34. Pin 44 is inserted into positioning hole 45 for fixing the relative positional relationship between condenser 22 and receiver 23. The surface of block 29 and the surface of block 33 facing each other are brought into contact with each other.

Receiver 23 contains filters 35 and desiccant 36. Filters 35 fix desiccant 36 from both upper and lower sides in receiver 23. Receiver 23 also may have auxiliary equipment. In this embodiment, pressure switch 51 is attached on receiver 23 for detecting a pressure of refrigerant in receiver 23.

In this embodiment, receiver 23 is disposed on the side of header pipe 25 of condenser 22 so that receiver 23 extends in a direction parallel to the direction in which header pipe 25 extends. Outlet portion 28 of condenser 22 communicates with inlet portion 32 of receiver 23 with a gastight condition by inserting insertion portion 30, provided on block 29, into insertion hole 34, defined in block 33. At the same time, block 29 and block 33 are positioned at a predetermined positional relationship by inserting pin 44 into positioning hole 45. Receiver 23 extends vertically along header pipe 25. A block 38 forming an outlet portion 37 of refrigerant of receiver 23 provided on the upper end of receiver 23 is attached to header pipe 25 via bracket 39. Bracket 39 is connected to the outer surface of header pipe 25. Block 38 is fixed to bracket 39 via screw 40 so that receiver 23 is fixed to header pipe 25 via bracket 39.

In condenser equipped with a receiver 21 of this embodiment, receiver 23 is attached to condenser 22 as follows. Insertion portion 30 of outlet portion 28 of condenser 22 is inserted into inlet portion 32 of receiver 23 by moving receiver 23 in its axial direction. O-ring 31 functions to achieve a gastight connection between insertion portion 30 and inlet portion 32. At the same time, pin 44 is inserted into positioning hole 45 so that receiver 23 is positioned relative to condenser 22 accurately in a predetermined positional relationship. Block 29, forming outlet portion 28, and block 33, forming inlet portion 32, are brought into contact with each other. Thus, outlet portion 28 of condenser 22 and inlet portion 32 of receiver 23 are assembled to each other and communicate with each other with a gastight connection by such an operation. When receiver 23 is detached from condenser 22, receiver 23 may be merely moved in its axial direction opposite to the direction for attachment.

Thus, the detachment or separation of receiver 23 from condenser 22 may be achieved also by such an operation. As a result, the workability for assembly of receiver 23 to condenser 22 and the maintainability of receiver 23 after it is mounted on a vehicle may be both facilitated.

Further, in this embodiment, the lower end portion of receiver 23, that is, inlet portion 32 of receiver 23, is fixed to outlet portion 28 of condenser 22 via the insertion structure of insertion portion 30, and the upper end portion of receiver 23, that is, outlet portion 37 of receiver 23, is fixed to bracket 39 connected to header pipe 25, which is sufficiently strong. Therefore, receiver 23 may be fixed to condenser 22 at both end portions with a sufficiently strong connection, thereby ensuring a strong connection between receiver 23 and condenser 22. Further, in this embodiment, because outlet portion 37 of receiver 23 is fixed to bracket 39 via screw 40, the attachment of receiver 23 to condenser 22 and the detachment of receiver 23 from condenser 22 may both be facilitated.

In the above-described embodiments, although insertion portions 10, 30 are provided on outlet portions 8, 28 of condensers 2, 22 and insertion holes 14, 34 are defined in inlet portions 12, 32 of receivers 3, 23, the insertion portions may be provided on inlet portions 12, 32 of receivers 3, 23 and the insertion holes may be defined in outlet portions 8, 28 of condensers 2, 22. Further, pins 42, 44 may be provided on inlet portions 12, 32 and positioning holes 43, 45 may be defined on outlet portions 8, 28.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A condenser equipped with a receiver comprising:

an inlet portion for refrigerant of said receiver, said inlet portion comprising a block member and opening in an axial direction of said receiver;

an outlet portion for refrigerant of said condenser comprising a block member and communicating with said inlet portion of said receiver; and an insertion portion provided on one of said inlet portion and said outlet portion, said inlet portion extending in said axial direction of said receiver, said inlet and said outlet portion being assembled to each other only by inserting said insertion portion into one of said outlet portion and said inlet portion, and said inlet portion and said outlet portion being brought into contact with each other, said contact between said inlet portion and said outlet portion being a gastight seal.

2. The condenser equipped with a receiver of claim 1, wherein said condenser comprises a multi-flow type heat exchanger including a pair of header pipes, a plurality of heat transfer tubes interconnecting said pair of header pipes, and a plurality of fins disposed between said heat transfer tubes that are adjacent to each other.

3. The condenser equipped with a receiver of claim 2, wherein said receiver extends in a direction parallel to a direction in which one of said pair of header pipes extends.

4. The condenser equipped with a receiver of claim 3, wherein said receiver is fixed to said one of said pair of header pipes.

5. The condenser equipped with a receiver of claim 1, wherein said receiver contains a desiccant and at least one filter.

6. The condenser equipped with a receiver of claim 1, wherein said receiver is provided with auxiliary equipment.

7. The condenser equipped with a receiver of claim 6, wherein said auxiliary equipment comprises a pressure switch.

8. A condenser equipped with a receiver comprising:

an inlet portion for refrigerant of said receiver, said inlet portion opening in an axial direction of said receiver;

an outlet portion for refrigerant of said condenser communicating with said inlet portion of said receiver; and an insertion portion provided on one of said inlet portion and said outlet portion, said insertion portion being inserted into one of said outlet portion and said inlet portion, and said inlet portion and said outlet portion being brought into contact with each other, said contact between said inlet portion and said outlet portion being a gastight seal;

wherein said condenser comprises a multi-flow type heat exchanger including a pair of header pipes, a plurality of heat transfer tubes interconnecting said pair of header pipes, and a plurality of fins disposed between said heat transfer tubes that are adjacent to each other; and said receiver extends in a direction parallel to a direction in which said heat transfer tubes extend.

9. The condenser equipped with a receiver of claim 8, wherein said receiver is fixed to a side member provided at one of several outermost positions of said multi-flow type heat exchanger.

* * * * *